US007883401B1

(12) United States Patent
String

(10) Patent No.: US 7,883,401 B1
(45) Date of Patent: Feb. 8, 2011

(54) COIN PLATE WITH DIVERTER FINGER

(76) Inventor: Gregory F. String, 411 Huron Dr., Mechanicsburg, PA (US) 17050

( * ) Notice: Subject to any disclaimer, the term of this patent is extended or adjusted under 35 U.S.C. 154(b) by 546 days.

(21) Appl. No.: 11/832,685

(22) Filed: Aug. 2, 2007

Related U.S. Application Data

(60) Provisional application No. 60/821,283, filed on Aug. 3, 2006.

(51) Int. Cl.
*G07D 3/02* (2006.01)
*G07D 3/06* (2006.01)

(52) U.S. Cl. ..... 453/10

(58) Field of Classification Search ..... 453/10, 453/12–15, 49, 57, 9; 209/539, 651, 659, 209/680, 707, 919; 198/359, 367, 416, 434, 198/803.16
See application file for complete search history.

(56) References Cited

U.S. PATENT DOCUMENTS 3,771,538 A * 11/1973 Reis ..... 453/12
4,798,558 A * 1/1989 Bellis ..... 453/32
6,039,643 A 3/2000 Kurosawa et al.
6,080,056 A * 6/2000 Karlsson ..... 453/3
6,685,552 B2 2/2004 Nomura
6,729,461 B2 * 5/2004 Brandle et al. ..... 194/317
7,188,720 B2 3/2007 Geib et al.
2005/0003750 A1 1/2005 Inuki et al.
2007/0010185 A1 * 1/2007 Karlsson et al. ..... 453/3

* cited by examiner

*Primary Examiner*—Stefanos Karmis
*Assistant Examiner*—Mark J Beauchaine
(74) *Attorney, Agent, or Firm*—Hooker & Habib, P.C.

(57) ABSTRACT

The coin plate of a coin processing or sorting machine having one or more coin slots includes a stationary diverter finger that is attached to the surface of the plate. The finger is located radially inwardly of the coin slot or coin slots and extends downstream to preferably the most downstream slot. A coin that is located radially inwardly from the intended, correct position with respect to the coin slots engages the diverter finger and is directed along the diverter finger radially outwardly and towards the last downstream coin slot so that the coin passes through the slot and is removed from the plate.

5 Claims, 2 Drawing Sheets

COIN PLATE WITH DIVERTER FINGER

This application claims priority to my pending provisional patent application having Application No. 60/821,283 and filed Aug. 3, 2006.

FIELD OF THE INVENTION

The invention relates to coin processing machines, and particularly to coin processing machines that include a circular coin plate to sort or verify coins.

BACKGROUND OF THE INVENTION

My published US patent application US20060154589 (which is incorporated by reference as if fully set forth herein) discloses a coin processing machine of the type having a stationary, circular coin plate 110 as shown in FIG. 2 that receives coins for sorting or verifying. In one embodiment the coin plate is a sorting plate that includes a number of circumferentially spaced slots 112, 114, 116 located at the outer periphery of the plate. The slots are arranged in order of increasing radial width, with the width of the slots related to the diameter, and hence denomination, of the coins to be sorted by the plate.

A stream of coins is fed onto the sorting plate and driven along the outer periphery of the plate in the downstream direction indicated by arrow 117 by a rotating drive disk 118 located above the sorting plate. The coins abut against a wall 120 that extends partially along the outer periphery of the plate. The wall 120 includes an inner abutment surface that extends above the plate that guides and resists outer radial movement of the coins moving along at the outer periphery of the plate. Fingers or other contact members (not shown) extend from the drive disk and engage the coins on the disk and urge the coins to move circumferentially downstream along the sorting plate. As the coins pass over a slot, coins of the denomination associated with slot pass through the slot and are removed from the plate. The larger coins slide over the slot and pass through a downstream slot.

On rare occasions a coin enters on the sorting plate but does not move to the outer periphery of the plate. The drive disk fingers hold the coin radially inwardly of its intended radial location on the plate with respect to the coin slots. The drive disk drives the coin, but the coin is not correctly positioned on the sorting plate to fall through the coin slots. The coin may remain on the sorting plate and be continuously driven by the drive disk without ever falling through a coin slot.

A coin driven on the plate without falling through a coin slot can prematurely wear the plate. The coin may be sensed or counted by coin denomination sensors each time the coin laps the plate, producing an erroneous coin count.

Thus there is a need to prevent coins that are not correctly positioned on the sorting plate to be removed from the sorting plate.

SUMMARY OF THE INVENTION

The invention is an improved coin plate that prevents coins that are not correctly positioned on the plate to be removed from the plate.

The coin plate of the present invention includes a stationary diverter finger that is attached to the surface of the plate. The finger is located radially inwardly of the coin slot or coin slots and extends downstream to preferably the most downstream slot. A coin that is located radially inwardly from the intended, correct position with respect to the coin slots engages the diverter finger and is driven along the diverter finger by the drive disk. The diverter finger urges the coin radially outwardly and towards the last downstream coin slot so that the coin passes through the slot and is removed from the plate.

In some embodiments of the invention the last coin slot is also intended to remove the largest-diameter coin to be sorted. Coins that engage the diverter finger also pass through the last coin slot and so may become intermingled with the largest-diameter coins. Further processing may be required to separate largest-diameter coins and those other coins intermingled with them. If the number of largest-diameter coins (for example, half-dollars) is small, such processing may have only a negligible impact on machine productivity.

In yet other embodiments of the invention the last coin slot is not intended to sort coins from the coin stream, but is instead intended to remove larger slugs, bent coins, and the like that are correctly positioned on the sorting plate but do not fall through the upstream coin-denomination slots. The last coin slot in this embodiment can have a greater width than the second-to-last slot which is preferably sized to remove largest-diameter coins. Coins that engage the diverter finger also fall through this last slot and so are not mixed with coins that fall through the upstream coin-denomination slots.

Other objects and features of the invention will become apparent as the description proceeds, especially when taken in conjunction with the accompanying figure illustrating an embodiment of the invention.

DESCRIPTION OF THE PREFERRED EMBODIMENT

Figure 1:
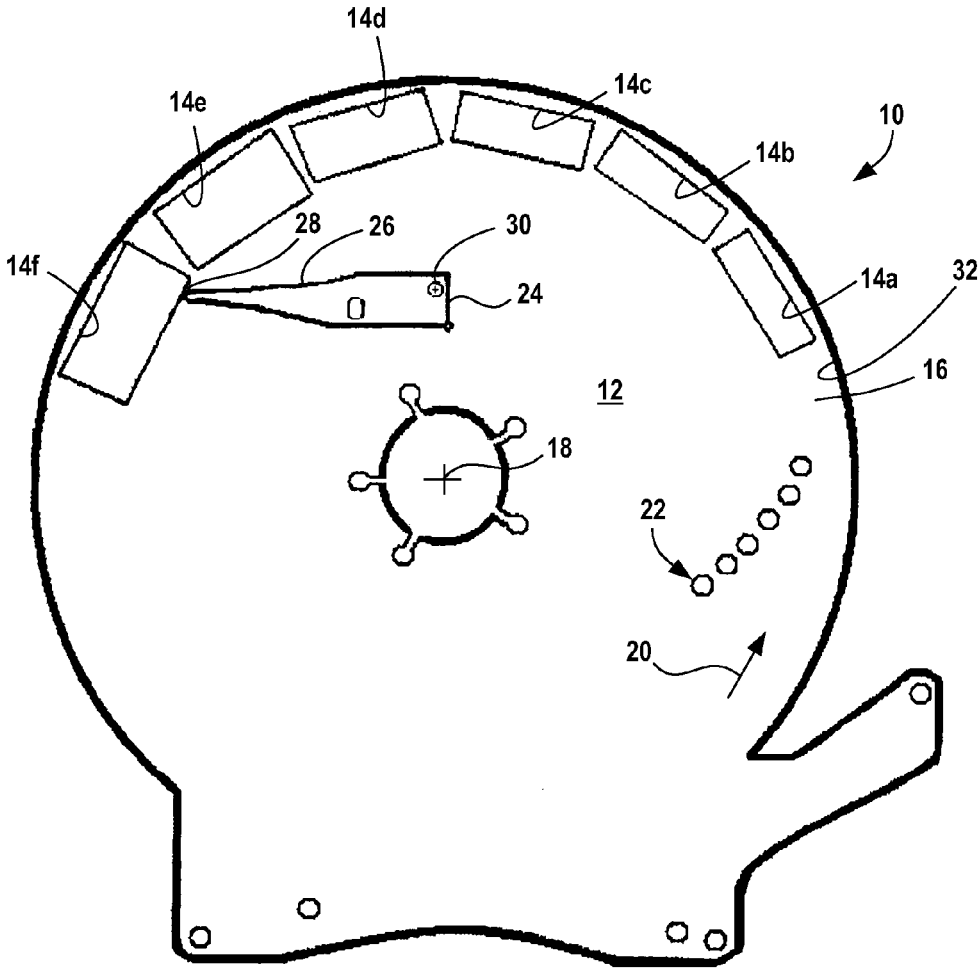
FIG. 1 is a top view of a coin plate in accordance with the present invention.
Figure 2:
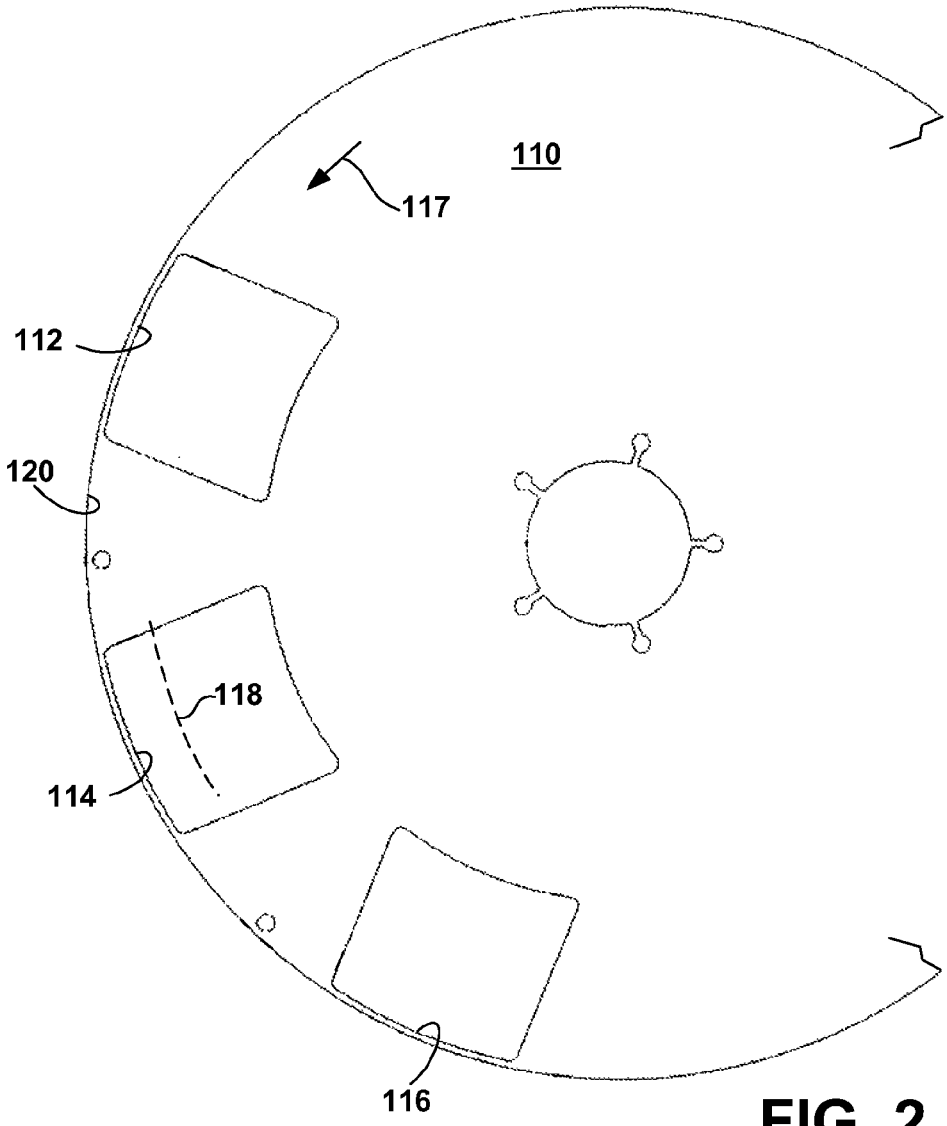
FIG. 2 PRIOR ART
FIG. 2 is a top view of a portion of a conventional, prior art coin plate.

FIG. 1 illustrates a coin plate 10. Plate 10 is configured as a coin sorting plate and has an upper surface 12 that supports coins to be sorted on the plate. A number of circumferentially spaced coin slots 14*a*-14*e* are located along the outer periphery 16 of sorting plate 10 with respect to a center axis 18. The slots 14*a*-14*e* are sized to sort U.S. denomination coins in increasing diameters from dimes to half-dollars, and are arranged in increasing diameter in the downstream direction of coin flow 20 (counterclockwise as shown in the figure) in a conventional manner. A sensor array 22 upstream of slots 14 senses the diameter, and hence denomination, of the coins before the coins reach slots 14. The sensor array 22 is also disclosed in my published '589 patent application.

Mounted against the upper surface 12 of sorting plate 10 is a diverter finger 24. Diverter finger 24 is located radially inwardly from the slots 14 and includes an abutment or diverting surface 26 that faces the incoming direction of coin flow and extends downstream to a free end 28 of finger 24. Free end 28 is located just downstream from the upstream end of the most downstream coin slot 14*f*.

Finger 24 is preferably made of metal plate, and is preferably thinner than the thinnest denomination coin to be sorted on plate 10, and most preferably is sufficiently thin not to engage or contact the drive fingers of the drive disk (not shown). Finger 24 is held against surface 12 by screw 30.

When sorting coins, a stream of singulated coins is fed onto surface 12 upstream from sensor array 22. The coins bear against a periphery wall 32 that radially locates the coins with respect to the coin slots 14. As the coins pass over sensor array 22, the sensor array 22 determines the diameter of each coin and sends a signal representing the denomination of each coin to a central processor (not shown). The coin stream then passes over the coin slots 14, and each diameter of coin passes through the slot associated with that coin diameter and is removed from the sorting plate.

If the occasional stray or bent coin does not bear against periphery wall 32 when fed onto sorting plate 10, it may be held inwardly of the wall by the fingers of the drive disk. As the coin moves downstream, the coin will engage diverting surface 26 of finger 24 and the inner edge of the coin will be urged to free end 28. The coin will then be positioned to fall through slot 14*f* and will be removed from plate 10.

In the illustrated embodiment stray coins are forced by diverter finger 24 to pass through half-dollar slot 14*f*. In other embodiments diverter finger 24 can be positioned to extend to an additional downstream coin slot that is provided solely to remove stray coins that engage finger 24. This coin slot can be made larger than the largest-diameter coin slot.

In yet other embodiments coin plate 10 can be configured as a verifier plate having a single coin slot that receives all coins. Sensor array 22 determines the denominations of the coins, but the coins are not physically sorted by the plate after being counted by array 22. Diverter finger 24 would be positioned to divert stray coins into the single coin slot. In yet further verifier embodiments the diverter finger 24 could be positioned to extend downstream to an additional downstream coin slot that receives stray coins diverted by the diverter finger.

It should also be recognized that the diverter finger of the present invention may be used with coin plates having different types of coin-discrimination sensors or sensor arrays, or different arrangements or spacings of coin slots.

While I have illustrated and described a preferred embodiment of my invention, it is understood that this is capable of modification, and I therefore do not wish to be limited to the precise details set forth, but desire to avail myself of such changes and alterations as fall within the purview of the following claims.

What I claim as my invention is:

1. A coin processing device for processing a stream of coins, the coin processing device comprising:

a stationary coin plate having an upper surface, a circular outer periphery, and a coin slot extending from the upper surface through a thickness of the plate, the coin slot sized to discharge coins from the coin plate, the upper surface defining a coin processing track extending at least partially along the outer periphery of the coin plate, the coin processing track having an intake end to receive the stream of coins on the upper surface and extending in a downstream direction to the coin slot;

a disk facing the upper surface of the coin plate and rotatable about an axis with respect to the coin plate, the disk and coin plate cooperatively spaced from one another wherein rotation of the disk drives the stream of coins downstream along the coin processing track;

a wall extending along the outer periphery of the coin plate adjacent the coin processing track, the wall comprising a stationary abutment surface to abut and thereby guide coins driven along the coin processing track, the coin plate spaced from the wall such that a coin abutting the wall as the coin moves along the coin processing track falls through the coin slot; and a diverter located between the coin plate and the disk outside of the coin processing track, the diverter comprising an abutment surface adjacent to and radially inward of the coin slot and disposed to engage misaligned coins driven along the coin processing track but not abutting against the wall, the diverter abutment surface stationary and fixed in position with respect to said wall and disposed to urge such misaligned coins towards the coin slot for discharge from the coin plate.

2. The coin processing device of claim 1 wherein the abutment surface of the diverter is an elongate surface that extends to a free end of the diverter, the abutment surface extending radially outwardly as it extends towards the free end.

3. The coin processing device of claim 1 wherein the coin slot has an upstream end and the abutment surface of the diverter is located in the downstream direction from the upstream end of the coin slot.

4. The coin processing device of claim 1 wherein the diverter is located against the upper surface of the coin plate.

5. The coin processing device of claim 1 wherein the coin slot represents a downstream coin slot and the coin plate comprises at least one additional upstream coin slot located along the coin processing track upstream from said downstream coin slot.

* * * * *